US006468631B1

(12) United States Patent
Pahl et al.

(10) Patent No.: US 6,468,631 B1
(45) Date of Patent: Oct. 22, 2002

(54) ELASTIC BAND-SHAPED BASE, SPECIALLY TRACK-BED MATTING

(75) Inventors: Bernd Pahl, Hamburg; Jan Thiedeitz, Norderstedt; Norbert Garbers, Dassendorf; Michail Rabkin, Hamburg, all of (DE)

(73) Assignee: Phoenix Aktiengesellschaft, Hamburg (DE)

( * ) Notice: Subject to any disclaimer, the term of this patent is extended or adjusted under 35 U.S.C. 154(b) by 0 days.

(21) Appl. No.: 09/355,016

(22) PCT Filed: Jan. 12, 1998

(86) PCT No.: PCT/DE98/00082

§ 371 (c)(1),
(2), (4) Date: Jul. 21, 1999

(87) PCT Pub. No.: WO98/32924

PCT Pub. Date: Jul. 30, 1998

(30) Foreign Application Priority Data

Jan. 22, 1997 (DE) ..... 197 01 906

(51) Int. Cl.[7] ..... B32B 3/20; B29D 22/00; E01B 1/00; E01B 9/68

(52) U.S. Cl. ..... 428/188; 428/36.9; 238/2; 238/382

(58) Field of Search ..... 238/2, 382; 428/188, 428/36.9

(56) References Cited

U.S. PATENT DOCUMENTS 659,242 A * 10/1900 Loeffler ..... 428/188
4,500,037 A 2/1985 Braitsch et al. ..... 238/2

* cited by examiner

*Primary Examiner*—Michael Barr
*Assistant Examiner*—Elena Tsoy
(74) *Attorney, Agent, or Firm*—Collard & Roe, P.C.

(57) ABSTRACT

Elastic band-shaped base (1) made of rubber or of a material similar to rubber for insulating and absorbing vibrations and impact sound, specially track-bed matting, wherein the base is fitted with spaced tubes (2, 3) running parallel to the ground side (4) of the base on at least two planes (I, II). The tubes have a semicircular, semi-oval, or semi-ellipsoidal cross section. The invention is characterized in that two planes (I, II) are arranged at a distance (A) in relation to each other, irrespective of the total number of the planes of tubes, forming a continuous intermediate covering (5) running parallel to the ground side (4) of the base (1), in such a way that the smoothed down sides of the tubes (2, 3) all face the intermediate covering (5). The inventive design provides for advantageous construction parameters of the elastic base.

11 Claims, 3 Drawing Sheets

ELASTIC BAND-SHAPED BASE, SPECIALLY TRACK-BED MATTING

The invention relates to an elastic band-shaped base made of rubber or a material similar to rubber for insulating and absorbing vibrations and impact sound, in particular to a track-bed matting, whereby the base is equipped with spaced tubes having a substantially semicircular, semi-oval or semi-elliposoidal cross section, whereby a portion of the tubes comprises a first plane and a second plane arranged with a spacing relative to each other, forming a continuous intermediate covering extending parallel with the ground side of the base, the tubes of said two planes being arranged displaced against one another with a spacing, forming a substantially symmetric lattice structure, whereby the spacing of the displacement amounts to about half of the spacing from the center of one tube to the center of the other tube within one plane. Such a base is known from laid-open document DE-A 3,935,354 (FIG. 4).

The elastic bases according to the prior art outlined above exhibit a linear behavior only in relatively short part areas (up to about 4 mm deformation).

Now, the problem of the invention is to provide an elastic base which exhibits a linear behavior also in the presence of large deformations (up to about 8 mm) for all sorts of different areas of application; however, in particular for application as a track-bed matting.

This problem is solved according to the characterizing part in that all flattened sides of the tubes of the first and second planes face the intermediate covering; and that another portion of tubes comprises a third plane arranged spaced from the next-disposed plane, forming a continuous intermediate covering extending parallel with the ground side of the base, whereby the tubes of the third plane each are disposed directly above the tubes of the next-disposed second plane.

The invention is explained in the following with the help of an exemplified embodiment and by reference to schematic drawings, in which.

Figure 1:
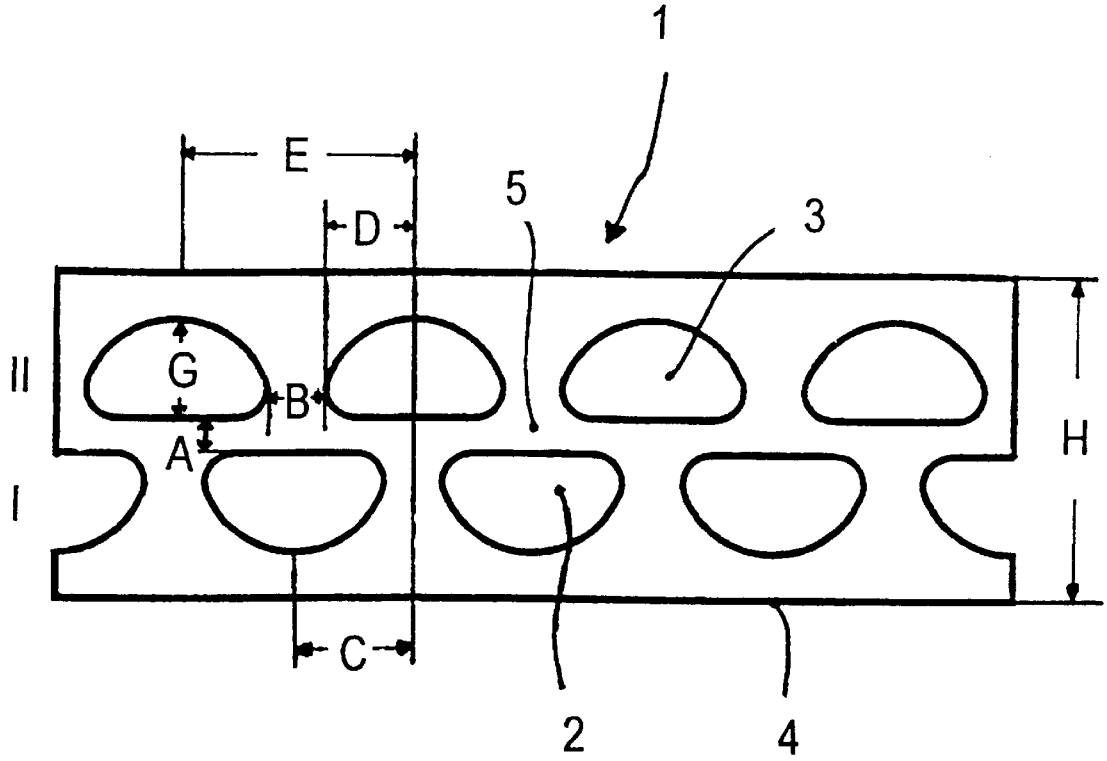
FIG. 1 shows the cross section of an elastic base, with two planes of tubes.

According to FIG. 1, the elastic base 1 with a total height H has two planes I, II of tubes 2, 3 extending parallel with ground side 4, whereby all tubes have a substantially semicircular cross sectional shape with height G and half-width spacing D. Said two planes are arranged with a spacing A relative to each other, forming a continuous intermediate covering 5 extending parallel with ground side 4, in such a way that the flattened sides of tubes 2, 3 all face the intermediate covering 5. Furthermore, the two planes are arranged displaced against each other with a spacing C, forming a substantially symmetric lattice structure (dashed lines). Within a plane, the tubes 2, 3 have a smallest peripheral spacing B at a spacing E from one center of a tube to another center of a tube.

Useful parameters of the structure are specified in the following, such parameters relating to the unloaded condition.

A 1 to 10 mm, in particular 2 to 4 mm
B (1 to 2.5) A
C 0.5 E or 0.5 B+D
D (1.5 to 2) B
E 2 D+B
G (0.5 to 1.5) D,in particular G≈D
H 10 to 50 mm, in particular 20 to 30 mm.

Figure 2:
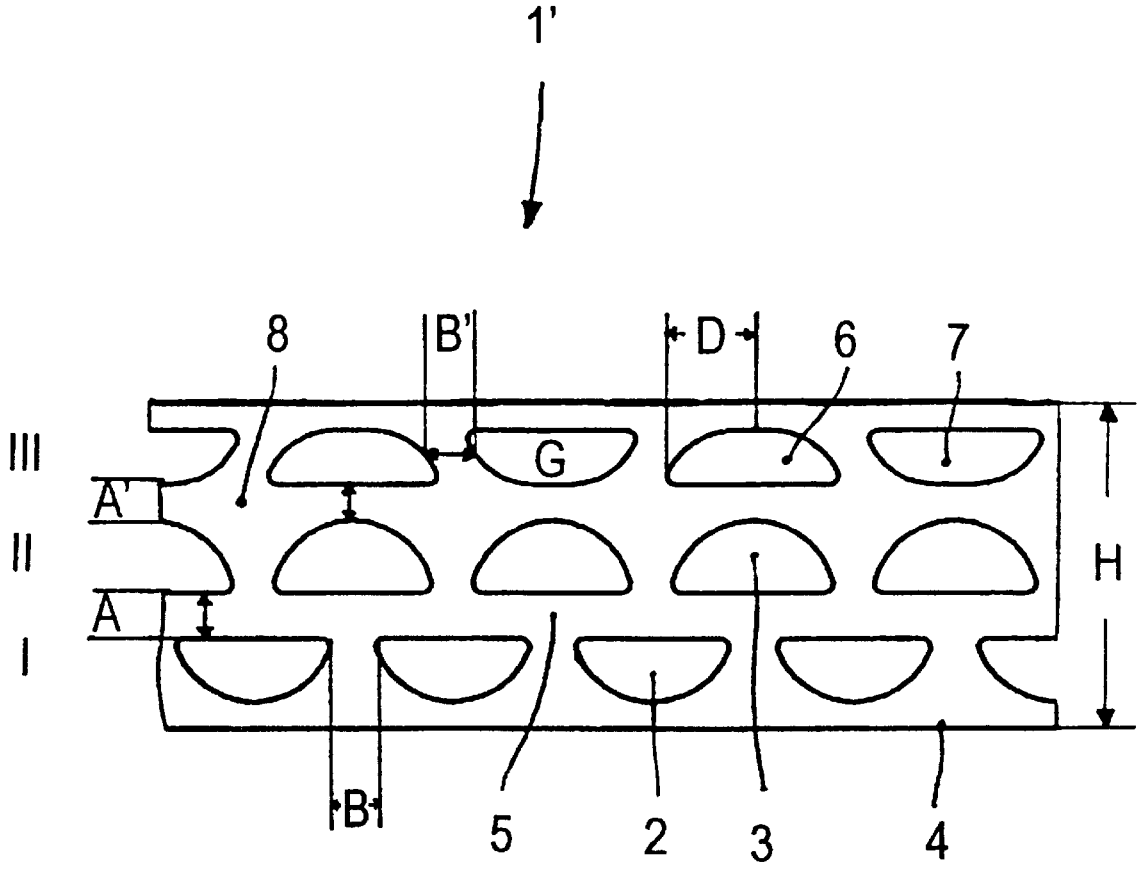
FIG. 2 shows the cross section of an elastic base as defined by the invention, with three planes of tubes.

According to FIG. 2, the elastic base 1' with a total height H has three planes I, II, III of tubes 2, 3, 6, 7, which extend parallel with ground side 4, whereby reference is made to the description of FIG. 1 with respect to the principle of the structure of planes I, II. The additionally installed third plane III of tubes 6, 7 is arranged with a spacing A' relative to the next-disposed plane II, forming a continuous intermediate covering 8 expending parallel with ground side 4, whereby the spacings A, A' between the individual planes are about equal. The tubes 6, 7 of the third plane III each are arranged directly above the tubes 3 of the next-disposed plane II. The smallest peripheral spacing B' between two tubes 2, 3 within the third plane III is about equal to the spacing B between two tunes 2, 3 within the two other planes I, II. Furthermore, the tubes 6, 7 within the third plane III are arranged with an alternating structure, namely in such a way that the flattened side of the tubes alternately point upwardly and downwardly. With respect to structure parameters G and D of tubes 6, 7, the same applies as to tubes 2, 3.

Figure 3:
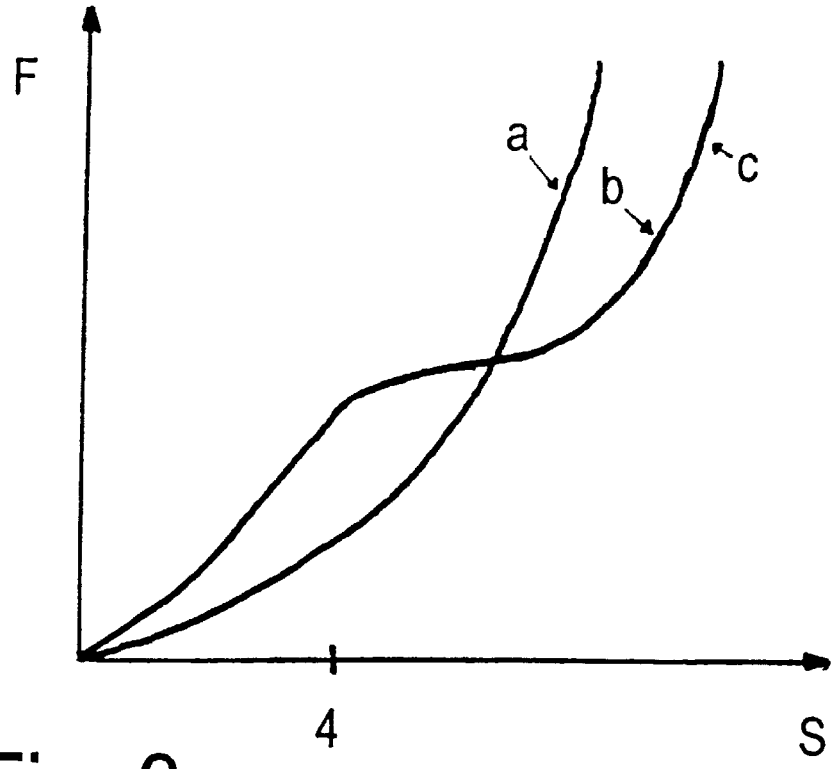
FIG. 3 shows the force-path behavior of leastic bases according to the prior art.
Figure 4:
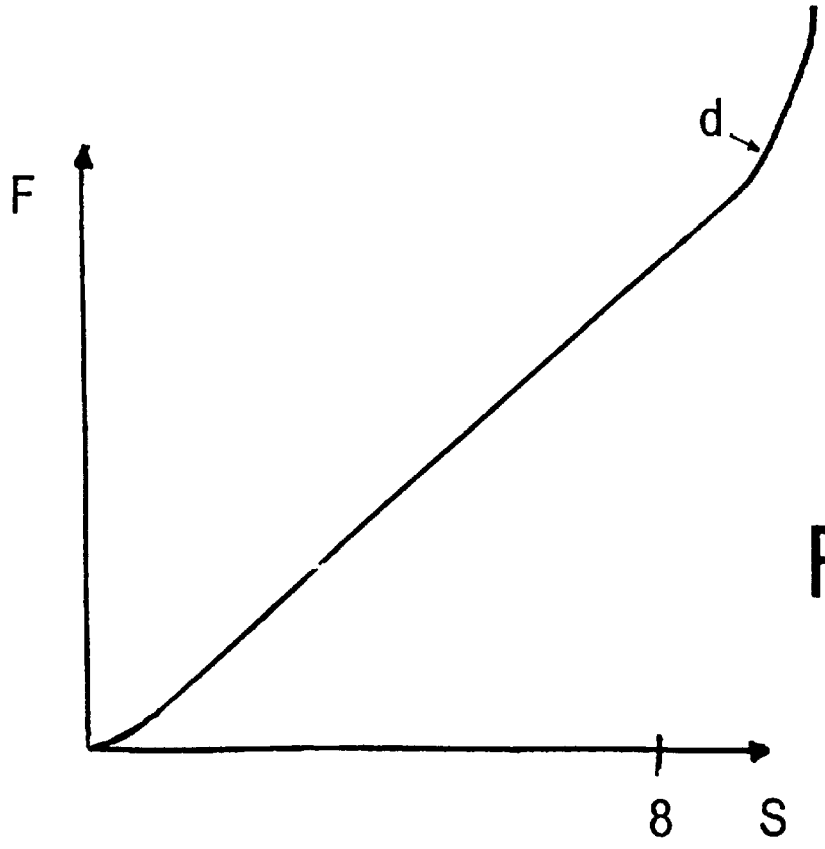
FIG. 4 shows the force-path behavior of an elastic base according to FIG. 1.

Now, FIGS. 3 and 4 show the force-path behavior of different elastic bases, whereby the following diagram data are applicable:

Ordinate: Force F [KN]
Abscissa: Path S [mm]
Curve a: Elastic base with only one plane of tubes with a circular cross section.
Curve b: Elastic base with two planes of tubes with a circular cross section and displaced against each other (lattice structure).
Curve c: Elastic base as a massive body consisting of polyurethane foam.
Curve d: Elastic base according to FIG. 1.

The comparison of curve d with curves a, b and c shows that a base having the structural principle of planes I and II according to FIG. 1, which also is realized in the base of the invention according to FIG. 2, offers the desired linear behavior up to a deformation of about 8 mm (operating range).

What is claimed is:

1. A track bed matting comprising an elastic band-shaped base (1, 1') made of rubber or rubber-like material for insulating and absorbing vibrations and impact sound, wherein the matting is equipped with tubes (2, 3, 6, 7) arranged with spacings between each other and having a substantially semicircular, semi-oval or semi-ellipsoidal cross section, whereby a portion of the tubes (2, 3) comprises a first plane (I) and a second plane (II) arranged with a spacing A relative to each other, forming a continuous intermediate covering (5) extending parallel with the ground side (4) of the matting (1, 1'), the tubes (2, 3) of said two planes (I, II) being arranged displaced against one another with a spacing C, forming a substantially symmetric lattice structure, whereby the spacing C of the displacement amounts to about half of the spacing E from the center of one tube to the center of the other tube within one plane (I, II); wherein all flattened sides of the tubes (2, 3) of the first plane (I) and the second plane (II) face the intermediate covering (5); and that another portion of the tubes (6, 7) comprises a third plane (III) arranged in a space A' from the next-disposed second plane (II), forming a continuous intermediate covering (8), extending parallel with the ground side (4) of the base (1'), whereby the tubes (6, 7) of the third plane (III) each are disposed directly above the tubes (3) of the next-disposed second plane (II).

2. The track bed matting according to claim 1, wherein the spacing A' of the intermediate covering (8) between the third plane (III) and the second plane (II) is approximately equal to the spacing A of the intermediate covering (5) between the first plane (I) and the second plane (II).

3. The track bed matting according to claim 1, wherein the spacing B' between two tubes (6,7) within the third pane (III) is about equal to the spacing B between two tubes (2,3) within the two other planes (I, II).

4. The track bed matting according to claim wherein the tubes (6, 7) within the third plane (III) are arranged with an alternating structure, in a way such that the flattened sides of the tubes alternately point upwards and downwards.

5. The track bed matting according to claim 1, wherein the spacing A, A' between the planes (I, II, III) amounts to 1 to 10 mm, in particular to 2 to 4 mm.

6. The track bed matting according to claim 1, wherein the smallest peripheral spacing B, B' between two tubes (2, 3, 6, 7) within a plane (I, II, III) is approximately equal to the spacing A, A' of one plane to another.

7. The track bed matting according to claim 1, wherein the smallest peripheral spacing B, B' between two tubes (2, 3, 6, 7) within a plane (I, II, III) is grater than the spacing A, A' of one plane to another, namely up to about 2.5 times the spacing A, A' between the planes (I, II, III).

8. The track bed matting according to claim 1, wherein the half-width spacing D of a tube (2, 3, 6, 7) is greater than the spacing B, B' between two tubes within a plane (I, II, III), whereby the spacing D is preferably 1.5 to 2 times the spacing B, B'.

9. The track bed matting according to claim 1, wherein the height G of a tube (2, 3, 6, 7) is 0.5 to 1.5 times the half-width spacing D of a tube.

10. The track bed matting according to claim 9, wherein the height G of a tube (2, 3, 6, 7) is about equal to the half-width spacing D of a tube.

11. The track bed matting according to claim 1, wherein the total height H of the matting (1, 1') amounts to 10 to 50 mm, in particular to 20 to 30 mm.

* * * * *